US006518879B2

(12) United States Patent
Koo et al.

(10) Patent No.: US 6,518,879 B2
(45) Date of Patent: Feb. 11, 2003

(54) APPARATUS AND METHOD FOR MONITORING LINE DISCONNECTION AND A FIRE, AND A FIRE ALARM SYSTEM HAVING THE SAME

(75) Inventors: Min-Sik Koo, Kyunggi-do (KR); Kang-Ok Kim, Inchun-kwangyokshi (KR)

(73) Assignee: Samsung Electronics Co., Ltd., Kyunggi-do (KR)

( * ) Notice: Subject to any disclaimer, the term of this patent is extended or adjusted under 35 U.S.C. 154(b) by 0 days.

(21) Appl. No.: 09/811,416

(22) Filed: Mar. 20, 2001

(65) Prior Publication Data

US 2002/0000914 A1 Jan. 3, 2002

(30) Foreign Application Priority Data

May 29, 2000 (KR) ..... 2000-28973

(51) Int. Cl.[7] ..... G08B 29/00

(52) U.S. Cl. ..... 340/506; 340/511; 340/531; 340/533; 340/537; 340/660

(58) Field of Search ..... 340/506, 511, 340/531, 533, 537, 657, 660, 661, 662, 512, 505, 3.1

(56) References Cited

U.S. PATENT DOCUMENTS

| | | | | |
|---|---|---|---|---|
| 4,568,923 A | | 2/1986 | Ouchi | 340/584 |
| 5,086,293 A | | 2/1992 | Takahashi et al. | 340/506 |
| 5,670,937 A | * | 9/1997 | Right et al. | 340/506 |

* cited by examiner

*Primary Examiner*—Daryl Pope
(74) *Attorney, Agent, or Firm*—Volentine Francos, PLLC

(57) ABSTRACT

A fire alarm apparatus, for checking line disconnection or occurrence of a fire, regardless of the installation place of a terminal endpoint resistor installed for checking disconnection of a line of fire detectors. When a signal representing a present voltage state of the detectors is input through the line, a control section compares the voltage level of the signal with a reference voltage level, and generates either a line disconnection control signal or a fire control signal. A first alarm section provides indication of disconnection of the line in response to the line disconnection control signal and a second alarm section provides indication of the occurrence of fire in response to the fire control signal. The apparatus can thus monitor a state of the detecting line, the common line and the fire detectors, regardless of the installation place of the terminal endpoint resistor.

20 Claims, 11 Drawing Sheets

APPARATUS AND METHOD FOR MONITORING LINE DISCONNECTION AND A FIRE, AND A FIRE ALARM SYSTEM HAVING THE SAME

The present application claims priority under 35 U.S.C. §119 to Korean Application No. 2000-28973, which is hereby incorporated by reference in its entirety for all purposes.

BACKGROUND OF THE INVENTION

1. Field of the Invention

The present invention relates to a fire alarm apparatus, and more particularly to an apparatus and a method for monitoring line disconnection and occurrence of fire, capable of checking line disconnection and occurrence of fire regardless of the installation place of a terminal endpoint resistor that is for monitoring disconnection of the line connected to a fire detector, and a fire alarm apparatus having the same.

2. Description of the Related Art

In general, in high and large buildings like offices and factories where many people come in and out, it is obligatory to install a fire alarm apparatus to minimize life injury by a fire. FIG. 1 shows a line-wiring state of a conventional fire alarm apparatus in which a fire detector directly detects fire. Referring to FIG. 1, a plurality of fire detectors 3, 4 and 5 for detecting a fire are installed between a repeater 1 and a transmitter 2. Lines of the plurality of fire detectors 3, 4 and 5 are mutually wired between the repeater 1 and the transmitter 2 to be electrically connected with one another.

When the plurality of fire detectors 3, 4 and 5 detect a fire, a fire detecting signal for informing occurrence of fire is provided from the fire detector which detects the fire, to the repeater 1. Repeater 1 informs a control center of the occurrence of fire through a fire receiver (not shown). In the above-mentioned fire alarm apparatus, the number of the plurality of the fire detectors 3, 4 and 5 will be greatly increased in accordance with the size of the building in which it is installed, and the length of the line which electrically connects the plurality of the fire detectors 3, 4 and 5 will also be increased in proportion to the area in which it is installed.

In general, in a fire alarm apparatus, terminal endpoint resistors 6 and 7 are installed, as shown in the FIG. 1, to check for a disconnection of the line of the fire detector, which is very long as described above. The terminal endpoint resistors 6 and 7 have to be installed at an end portion of the line, that is, at the reference mark "B" in FIG. 1. However, an equipment provider that installs a fire alarm apparatus may install the terminal endpoint resistor 6 at a center portion of the line; that is to say, at the reference mark "A" in FIG. 1, to avoid the trouble of maintenance and repair caused by line disconnection. When the terminal endpoint resistor 6 is installed in this way, at the position of the repeater 1, the line is detected as normal even though the line between installation place A of the terminal endpoint resistor 6 and the transmitter 2 is disconnected at reference mark "C", for instance. Therefore, the fire detectors 4 and 5 installed between the installation place A and the transmitter 2 are not able to detect a fire, and the fire alarm apparatus can not generate a fire alarm.

U.S. Pat. No. 5,086,293 (granted to Karou Takahashi et al.) titled "LINE INTERRUPTION SUPERVISORY DEVICE FOR A FIRE ALARM SYSTEM" discloses a line interruption supervising apparatus for a fire alarm system that is capable of monitoring a line state regardless of the line length and the number of fire detectors. According to the aforementioned apparatus, a voltage level of the power/signal lines before the power supply interruption is compared with a line voltage level after a lapse of a predetermined time from the power supply interruption, and the open/interruption state of the power/signal line for fire detecting is determined based on the compared result.

Also, U.S. Pat. No. 4,568,923 (granted to Hiroshi Ouchi) discloses a fire alarm system that is capable of detecting line disconnection of the alarm line, wherein the fire detectors are installed without discontinuing the fire detecting function.

However, according to the aforementioned conventional apparatuses, the systems are not capable of precisely checking the line disconnection state with respect to the installation place of the terminal endpoint resistors, and are not capable of controlling the fire alarm preferably with respect to the respective states of line disconnection and fire. Moreover, when a fire occurs, an indicating lamp mounted on transmitter 2 of FIG. 1 for example, is set to be continuously turned-on, so that it is difficult to locate the place of an in-house fireplug when a great deal of smoke is present.

SUMMARY OF THE INVENTION

The present invention is therefore directed an apparatus and method for monitoring line disconnection and occurrence of fire, which substantially overcomes one or more of the problems due to the limitations and disadvantages of the prior art.

Therefore, it is an object of the present invention to provide an apparatus and method for monitoring line disconnection and occurrence of fire, capable of checking line disconnection of the fire detector or occurrence of a fire regardless of the installation place of a terminal endpoint resistor that is installed for the purpose of checking disconnection of the line connected to a fire detector.

It is another object of the present invention to provide an apparatus and method that enable easy locating of an in-house fireplug.

It is still another object of the present invention to provide a fire alarm apparatus having an apparatus for monitoring line disconnection and occurrence of fire, capable of checking line disconnection of the fire detector or occurrence of a fire, regardless of the installation place of a terminal endpoint resistor that is installed for the purpose of checking disconnection of the line connected to the fire detector, while enabling an in-house fireplug to be easily located.

To achieve the aforementioned objects of the present invention, an apparatus for monitoring line disconnection and occurrence of fire according to a first embodiment of the present invention includes an operation verifier that outputs a first detecting voltage signal representing an operation state of a fire detector and that outputs a verification-confirming signal in response to a line disconnection-verifying signal, a first detector that outputs first and a second detecting signals respectively representing an operation state of the fire detector and a state of a first line of the fire detector in response to the first detecting voltage signal and the verification-confirming signal, and a second detector that receives a second detecting voltage signal representing the operation state of the fire detector to output a third detecting signal representing a state of a second line of the fire detector. Also, a controller receives the first, second and third detecting signals, compares a voltage level of the first detecting signal with a voltage level of a predetermined first reference value, provides the line disconnection-verifying signal to the operation verifier according to a compared result, based on the second detecting signal generated in accordance with a result of providing the line disconnection-verifying signal, generates either a first line disconnection control signal to inform a first line disconnection of the fire detector or a fire control signal to inform occurrence of fire, based on a comparison result of the voltage level of the third detecting signal with a voltage level of a predetermined second reference value, and generates a second line disconnection control signal to inform a second line disconnection of the fire detector.

An apparatus for monitoring line disconnection and occurrence of fire according to a second embodiment of the present invention, to achieve the above objects of the present invention, includes a plurality of detectors that detect occurrence of fire to output a fire occurring signal and a controller that receives a detecting voltage signal representing a present voltage state of the plurality of detectors through a line, compares a voltage level of the detecting voltage signal with a predetermined reference voltage level, and based on the compared result, generates either a line disconnection control signal or a fire control signal respectively representing disconnection of the line of the plurality of detectors or the occurrence of fire. In addition, a first alarm unit informs an operator of the disconnection of the line of the plurality of detectors in response to the line disconnection control signal, and a second alarm unit informs the operator of the occurrence of fire in response to the fire control signal.

To achieve the above objects of the present invention, the present invention provides a method for monitoring line disconnection and occurrence of fire in a fire alarm system, which includes comparing whether or not a voltage level of a first detecting signal representing a present voltage state of a fire detector is lower than a voltage level of a predetermined first reference value, generating a first line disconnection-verifying signal having a voltage value of high level and a second line disconnection-verifying signal having a voltage value of low level when the voltage level of the first detecting signal is lower than the voltage level of the predetermined first reference value and generating a line disconnection control signal representing line disconnection of the fire detector when a voltage level of a second detecting signal fed back through the line of the fire detector is respectively detected as a voltage level opposite to the voltage level of the first and the second line disconnection-verifying signals, and generating a fire control signal representing occurrence of fire regardless of the voltage level of the first and the second line disconnection-verifying signals when the voltage level of the second detecting signal fed back through the line of the fire detector is detected as a uniform voltage level.

In the above-mentioned apparatus of the first embodiment, the line disconnection-verifying signal is alternatively provided as a voltage signal of low level or as a voltage signal of high level corresponding to a predetermined period. Also, in the above mentioned apparatus of the second embodiment, the second alarm unit provides an alarm indicative of the occurrence of fire and the place thereof, by means of executing an on-and-off flashing operation to emit light.

According to the aforementioned fire alarm apparatus, the voltage level of a plurality of fire detectors in normal times is compared with a predetermined operation voltage level of the plurality of the fire detectors, which is set as a reference voltage level by a control section. In accordance with the compared result, the controller generates the line disconnection-verifying signal to receive the detecting signal representing the line state of a common line and a detecting line which are electrically connected to the plurality of fire detectors. Also, by means of comparing the detecting signal with another predetermined reference voltage level, the controller judges whether the detecting line and the common line are disconnected or whether a fire has occurred. The controller generates a line disconnection control signal or a fire control signal to control the fire alarm system according to the judged result.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENTS

A description will be given below in detail with reference to the accompanying drawings, regarding the configuration and operation of an apparatus and method for monitoring line disconnection or occurrence of fire, and a corresponding fire alarm system, according to preferred embodiments of the present invention.

Figure 1:
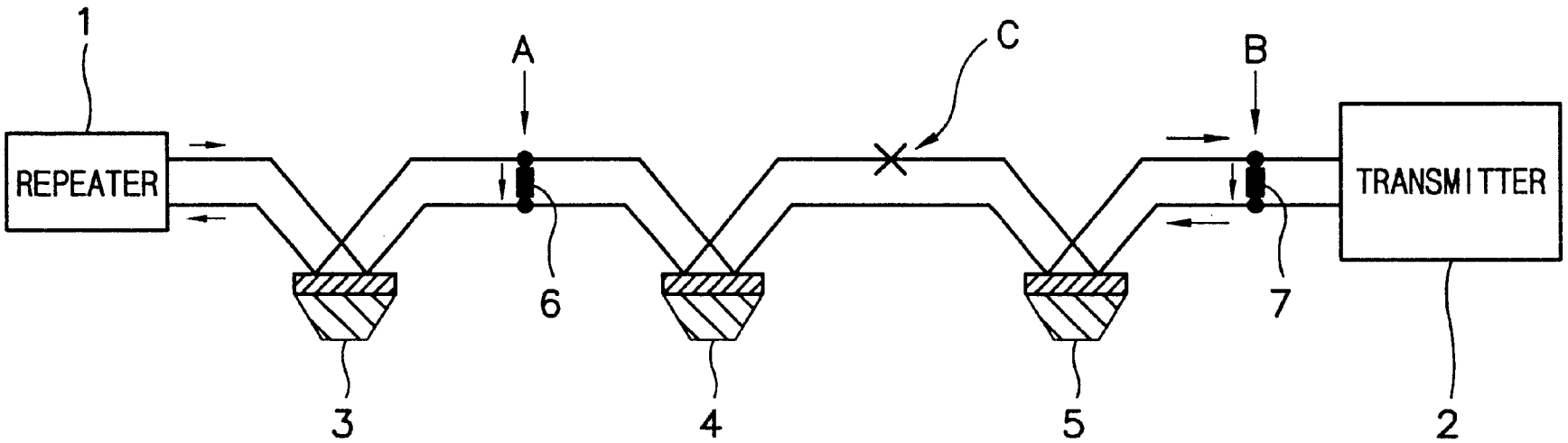
FIG. 1 (PRIOR ART)
FIG. 1 is a diagram showing the line wiring state of a conventional fire detector system.
Figure 2:
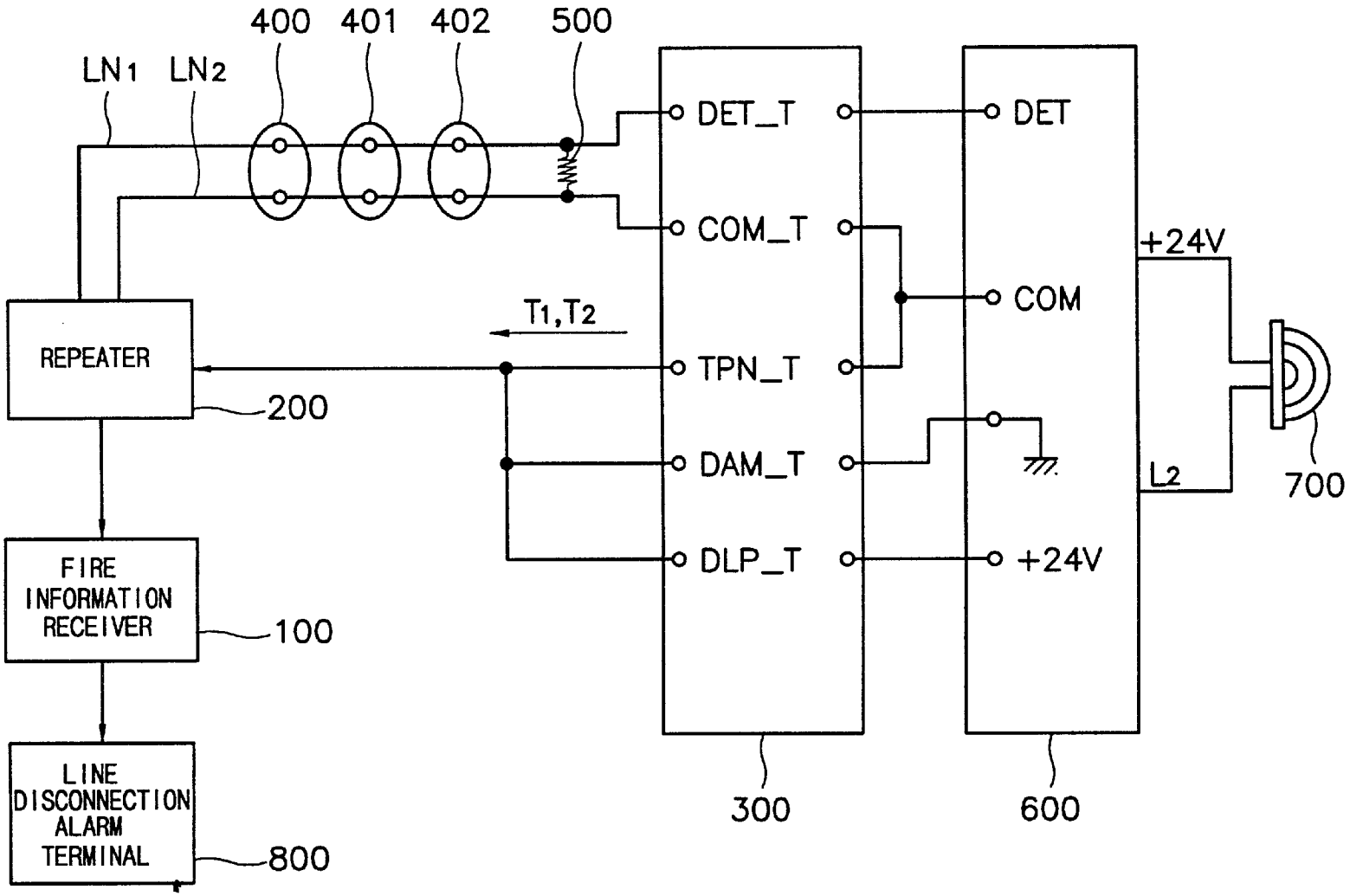
FIG. 2 is a block diagram showing the configuration of a fire alarm system having an apparatus for monitoring line disconnection or occurrence of fire, according to a preferred embodiment of the present invention.

FIG. 2 is a block diagram showing a circuit configuration of a fire alarm system having an apparatus for monitoring line disconnection or occurrence of fire, according to preferred embodiments of the present invention. Referring to FIG. 2, a plurality of detectors 400, 401 and 402 are installed between a repeater 200 and a transmitting terminal block 300 to be electrically connected with one another by a detecting line LN1 and a common line LN2. In the transmitting terminal block 300, there is a detecting terminal DET_T connected to the detecting line LN1, a common terminal COM_T connected to the common line LN2, a telephone terminal TPN_T, and an alarm bell/indicating lamp common terminal DAM_T, and an indicating lamp terminal DLP_T. A terminal endpoint resistor 500 is connected in between the detecting line LN1 and the common line LN2.

Here, detectors having a voltage characteristic as described in the following table are used as the plurality of fire detectors 400, 401 and 402. Referring to Table 1, the plurality of fire detectors 400, 401 and 402 normally have a voltage characteristic within the range of 18 volts to 26 volts, for instance 24 volts, and while in operation after detecting a fire, the plurality of fire detectors 400, 401 and 402 have a voltage characteristic within the range of 0 volt to 4.7 volts.

Among the terminals of the transmitting terminal block 300, the detecting terminal DET_T, the common and telephone terminals COM_T and TPN_T, the alarm bell/indicating lamp common terminal DAM_T, and the indicating lamp terminal DLP_T are respectively connected to a detecting line terminal, a common line terminal, a ground terminal, and a power source terminal of a line disconnection detecting circuit 600. The line disconnection detecting circuit 600 compares voltage levels of the voltage signals inputted through the detecting line terminal and the common line terminal with a reference voltage level to check disconnection of the two lines LN1, LN2 which are electrically connected to the fire detectors 400, 401 and 402. Also, the line disconnection detecting circuit 600 checks whether a fire occurs by comparing the voltage level of the voltage signal input through the detecting line terminal with another reference voltage level. The line disconnection detecting circuit 600 provides line disconnection driving signals T1 and T2 to either a fire information receiver 100 or the repeater 200 via the transmitting terminal block 300, when the detecting line LN1 or the common line LN2 is disconnected. When a fire occurs, the line disconnection detecting circuit 600 simultaneously generates the line disconnection driving signals T1 and T2 and a fire driving signal L2.

The line disconnection detecting circuit 600 is connected to an on-and-off indicating lamp 700. The on-and-off indicating lamp 700 carries out on-and-off flashing operation when the fire driving signal L2 is generated. The on-and-off flashing operation of the on-and-off indicating lamp 700 makes it easier for a user to locate the place of an in-house fireplug, even though a lot of smoke may be produced by the fire.

The repeater 200 receives the signals indicative of the line disconnection or the like from the terminals wired at the transmitting terminal block 300 and transmits the signals to the fire information receiver 100. Also, the repeater 200 detects the fact that a fire occurs and provides a signal which indicates the occurrence of fire, to the fire information receiver 100. The fire information receiver 100 supervises the fire detectors 400, 401 and 402 according to the signals transmitted from the repeater 200 and controls an operation of a line disconnection alarm generator 800 for informing the control center (not shown) of the line disconnection state.

Meanwhile, it may happen that the repeater 200 is not installed according to the predesigned installation method of the fire alarm system. In this case, the signals indicative of line disconnection or the like, may be directly transmitted from the terminals wired at the transmitting terminal block 300 to the fire information receiver 100.

TABLE 1

| by function | by type | voltage during normal times | voltage during operation times |
|---|---|---|---|
| conventional thermal detector | thermostat type (semiconductor type) | 18~26 V | 0.1~15 V |
| | thermostat type (conventional type) | 18~26 V | 0 |
| | differential type (semiconductor type) | 18~26 V | 0.1~5 V |
| | differential type (conventional type) | 18~26 V | 0.1~5 V |
| explosion proof thermal detector | thermostat type | 18~26 V | 0 |
| smoke detector | photoelectric type | 18~26 V | 0.1~5 V |
| | ionization type | 18~26 V | 0.1~5 V |
| transmitter | manual type | 18~26 V | 0 |
| circuit voltage | — | 18~26 V | 0 |

Hereinafter, a description will be given below with reference to FIG. 3 through FIG. 8, of a detailed configuration of the line disconnection detecting circuit 600 and an operation of a fire alarm apparatus using the same. FIG. 3 to FIG. 8 are circuit diagrams showing circuit configurations of a signal input/output section 610, a power supplying section 620, an operation verifying section 630, a second detecting section 650, a state displaying section 680, a reset section 670, an oscillating section 662, a control section 660, and an alarm driving section 690 of the line disconnection detecting circuit 600 shown in FIG. 2.

Figure 3:
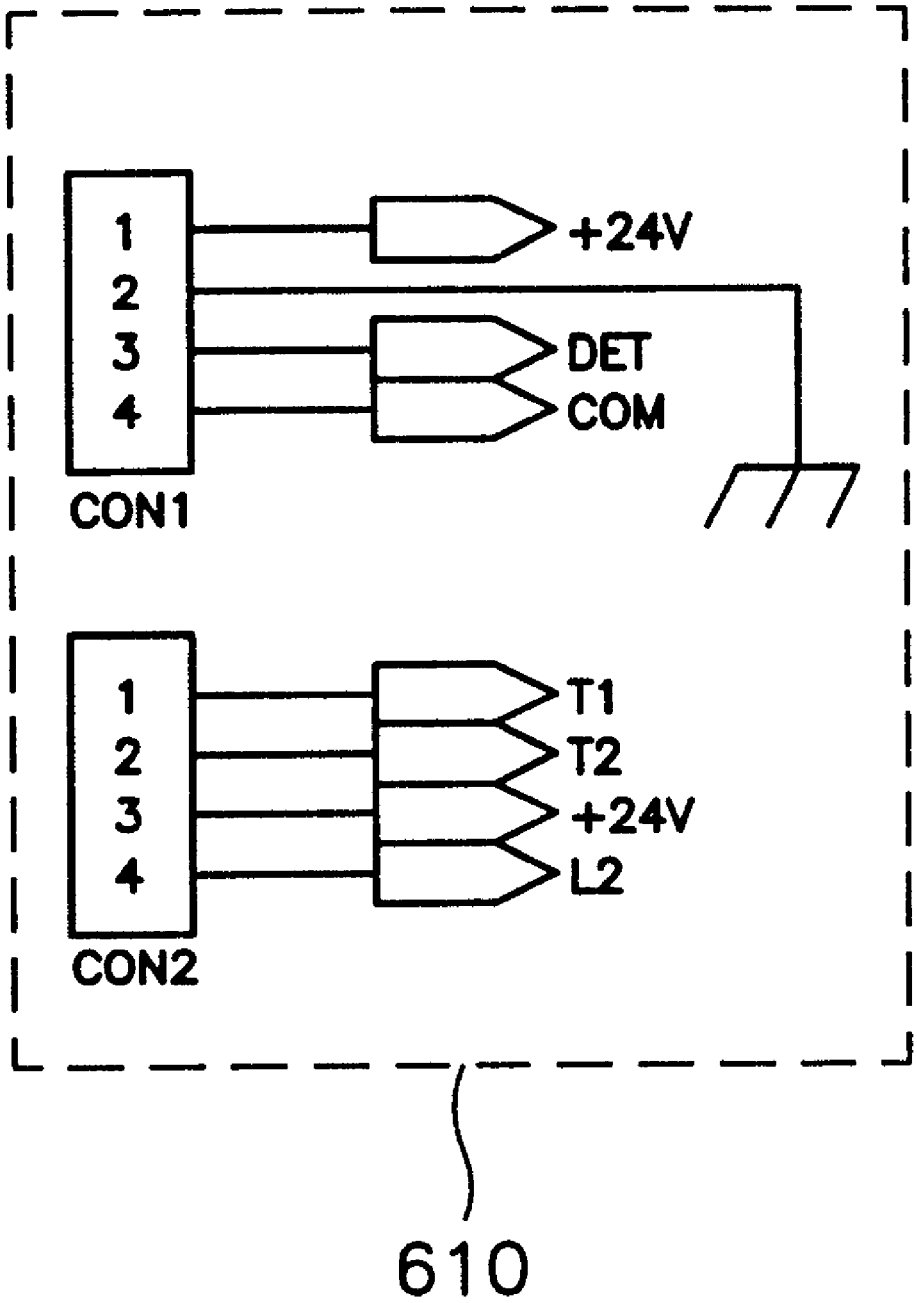
FIG. 3 is a circuit diagram showing a circuit configuration of a signal input/output section of the line disconnection detecting circuit shown in FIG. 2.

Referring to FIG. 3, the signal input/output section 610 of the line disconnection detecting circuit 600 has an input terminal block CON1 for receiving the signals from the transmitting terminal block 300 and an output terminal block CON2 for outputting the line disconnection driving signals T1 and T2 and the fire driving signal L2.

Figure 4:
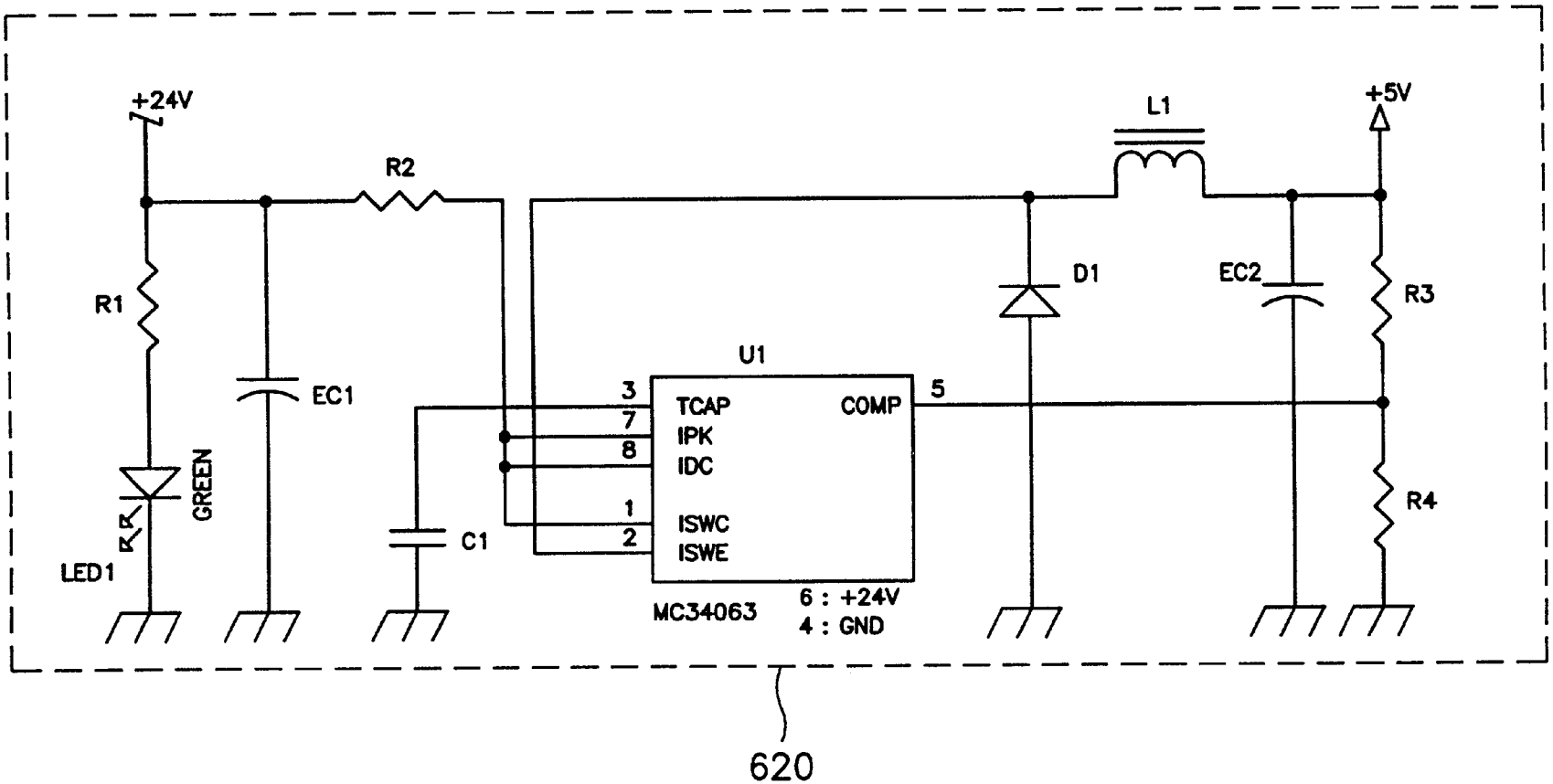
FIG. 4 is a circuit diagram showing a circuit configuration of a power supplying section of the line disconnection detecting circuit shown in FIG. 2.

Referring to FIG. 4, the power supplying section 620 has first through fourth resistors R1, R2, R3 and R4, first and second electrolytic capacitors EC1 and EC2, a first capacitor C1, a first light emitting diode LED1, a first diode D1, a first inductor L1 and a pulse width modulator U1. In general, pulse width modulator U1 executes an operation that stabilizes the level of the inputted power source, and may be a MOTOROLA MC34063 modulator for example. The first light emitting diode LED1 executes a light emitting operation in response to a power source voltage +24V inputted through the first resistor R1. The first light emitting diode LED1 is a green light emitting diode and it indicates whether or not the power source is supplied to the line disconnection detecting circuit 600. The power source voltage +24V is dropped to +5 volts by the first electrolytic capacitor EC1, the second resistor R2, the pulse width modulator U1, the first diode D1, the first inductor L1, the second electrolytic capacitor EC2 and the third and fourth resistors R3 and R4. The voltage dropped to +5 volts is provided as an operational voltage to respective elements of the line disconnection detecting circuit 600.

Figure 5:
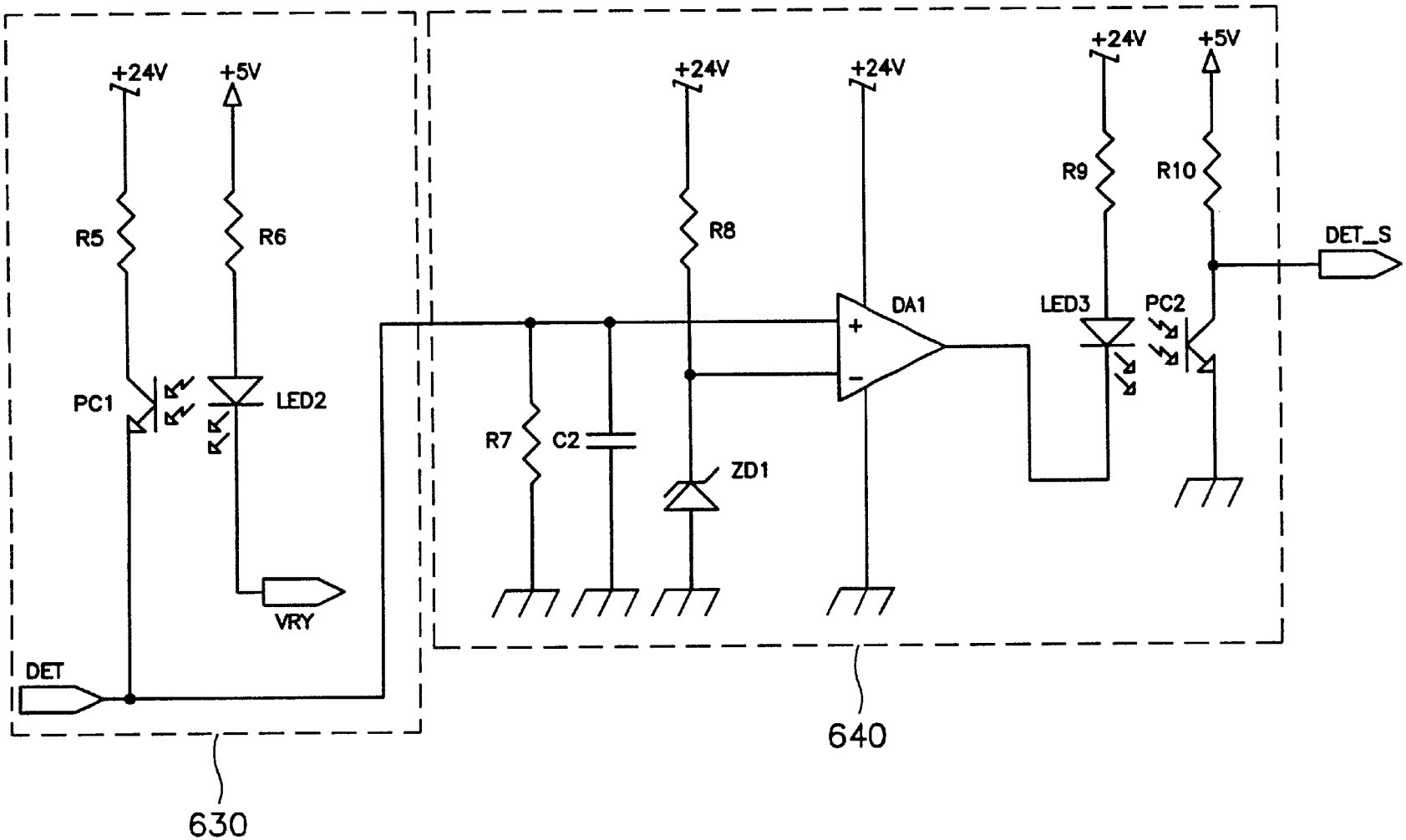
FIG. 5 is a circuit diagram showing a circuit configuration of an operation verifying section and a first detecting section of the line disconnection detecting circuit shown in FIG. 2.

Referring to FIG. 5, the operation verifying section 630 outputs to first detecting section 640, a first detecting voltage signal DET that is indicative of a voltage level of the plurality of fire detectors 400, 401 and 402 and that has been input to the operation verifying section 630 through the detecting line terminal. The operation verifying section 630 has a second light emitting diode LED2, responsive to a line disconnection-verifying signal VRY provided from a control section 660, which executes a light emitting operation by use of the operational voltage +5V provided from the power supplying section 620 through a sixth resistor R6. Also, the operation verifying section 630 has a first photo coupler PC1 which executes a switching operation in response to the light emitting operation of the second light emitting diode LED2 and outputs the power source voltage +24V inputted through a fifth resistor R5. The operation verifying section 630 thus also outputs a verification-confirming signal as operated results of the second light emitting diode LED2 and the first photo coupler PC1. At this time, the first detecting voltage signal DET has a voltage level within the range of 18 volts to 26 volts as described in the above Table 1 during normal times, and has a voltage level within the range of 0 volt or 0.1 volts to 5 volts while in operation after detecting of a fire.

The first detecting section 640 has a first differential amplifier DA1 that receives the detecting voltage signal DET provided from the operation verifying section 630 at a non-inverting input terminal (+) thereof and a constant voltage +5.1V caused by a zener diode ZD1 at an inverting input terminal (−) thereof, amplifies the differentiated value between the detecting voltage signal DET and the constant voltage +5.1V, and outputs the amplified value. The non-inverting input terminal (+) of the first differential amplifier DA1 is connected to a seventh resistor R7 and a second capacitor C2, and the inverting input terminal (−) of the first differential amplifier DA1 is connected between an eighth resistor R8 and the first zener diode ZD1 which are connected in series between the power source voltage +24V and ground.

Also, the first detecting section 640 has a third light emitting diode LED3 which executes a light emitting operation by means of the power source voltage +24V provided through a ninth resistor R9 in response to the output of the first differential amplifier DA1, and has a second photo coupler PC2 which carries out a switching operation corresponding to the light emitting operation of the third light emitting diode LED3 and which outputs the operational voltage +5V inputted through a tenth resistor R10. The first detecting section 640 provides the first and the second detecting signals to the control section 660 as an operational result of the third light emitting diode LED3 and the second photo coupler PC2. At this point, the first and the second detecting signals respectively indicate the signals outputted corresponding to the first detecting voltage signal DET and the verification-confirming signal. The first detecting signal has a voltage level of lower than 5 volts.

Figure 6:
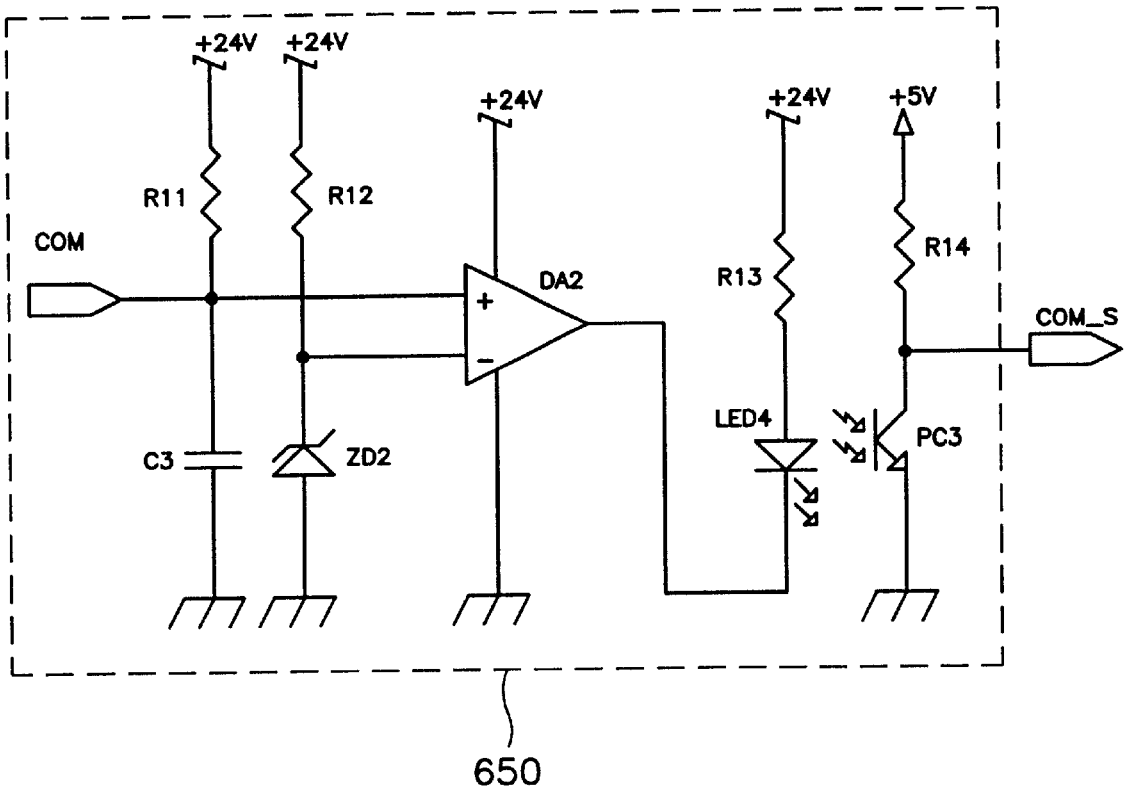
FIG. 6 is a circuit diagram showing a circuit configuration of a second detecting section of the line disconnection detecting circuit shown in FIG. 2.

Referring to FIG. 6, the second detecting section 650 has a second differential amplifier DA2 that receives at a non-inverting input terminal (+) thereof a second detecting voltage signal COM provided through the common terminal COM_T of the transmitting terminal block 300 and a constant voltage +5.1V caused by a second zener diode ZD2 at an inverting input terminal (−) thereof. The second differential amplifier DA2 amplifies the differentiated value between the second detecting voltage signal COM and the constant voltage +5.1V and outputs the amplified value. The non-inverting input terminal (+) of the second differential amplifier DA2 is connected between a eleventh resistor R11 and a third capacitor C3. Also, the inverting input terminal (−) of the second differential amplifier DA2 is connected between the second zener diode ZD2 and a twelfth resistor R12, which are connected in series between the power source voltage +24V and the ground.

Also, the second detecting section 650 has a fourth light emitting diode LED4 which carries out a light emitting operation by means of the power source voltage +24V provided through a thirteenth resistor R13 in response to the output of the second differential amplifier DA2. The second detecting section 650 has a third photo coupler PC3 which carries out a switching operation in response to the light emitting operation of the fourth light emitting diode LED4 and outputs the operational voltage +5V inputted through a fourteenth resistor R14. The second detecting section 650 provides a third detecting signal COM_S to the control section 660 as an operational result of the fourth light emitting diode LED4 and the third photo coupler PC2.

Figure 7:
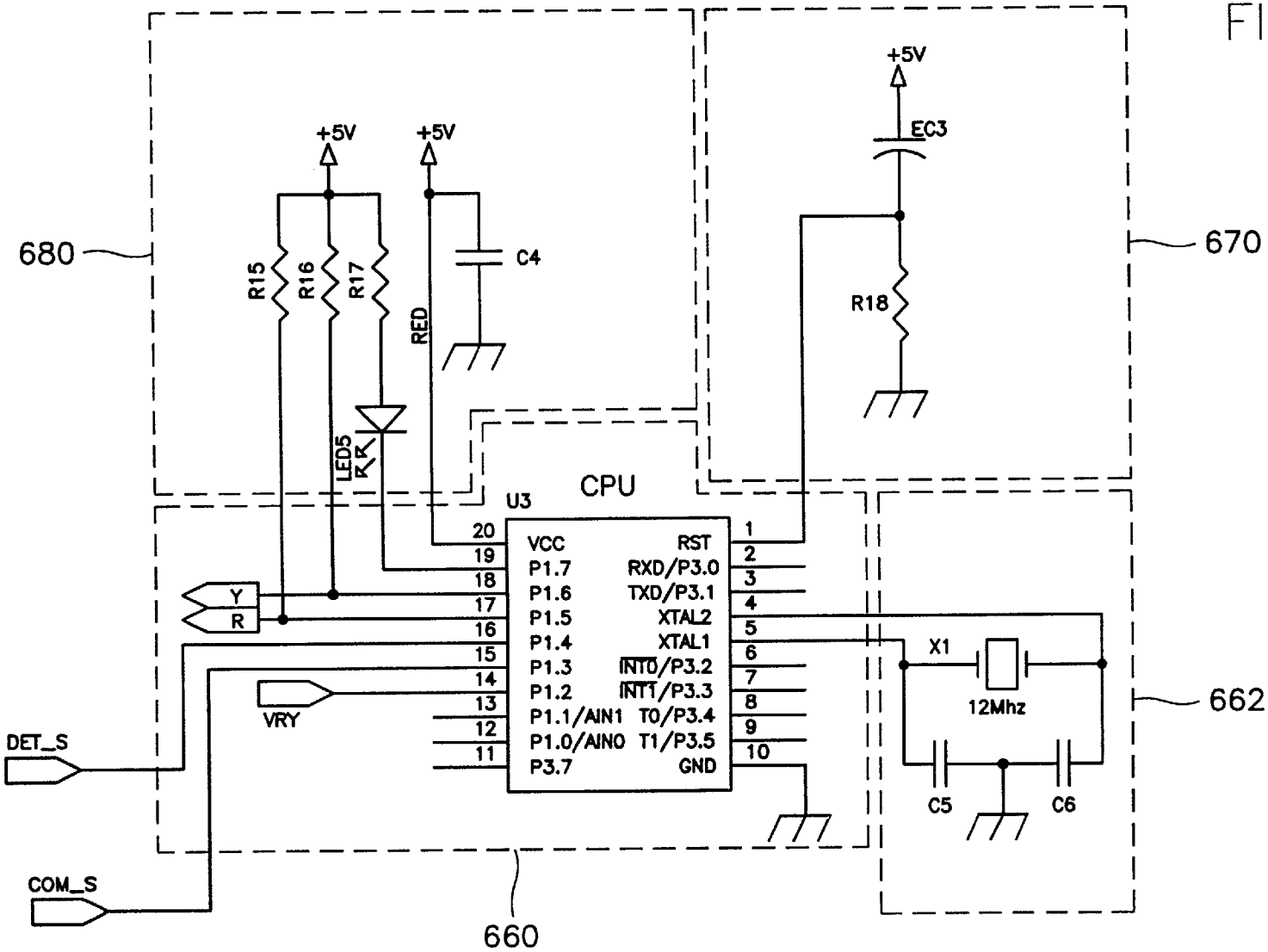
FIG. 7 is a circuit diagram showing circuit configurations of a state displaying section, a reset section, an oscillating section, and a control section of the line disconnection detecting circuit shown in FIG. 2.

Referring to FIG. 7, the control section 660 includes a CPU that controls the functions thereof. The CPU may be an INTEL 89C2051 or 89C1051 CPU, for example. Control section 660 is operated by synchronizing a clock signal provided from the oscillating section 662. The CPU of the control section 660 compares the voltage level of the first detecting signal from the first detecting section 640 with a predetermined first reference voltage level which is stored within a memory (not shown), and provides the line disconnection-verifying signal VRY to the operation verifying section 630 based on the compared result. That is, when the voltage level of the first detecting signal representing the normal voltage level of the plurality of fire detectors 400, 401 and 402 is lower than the first reference voltage level, the line disconnection-verifying signal VRY is generated from the control section 660.

Moreover, the CPU of the control section 660 generates either a line disconnection control signal R representing disconnection of the detecting line LN1, or a fire control signal Y representing the occurrence of fire in response to the second detecting signal inputted through the first detecting section 640 as a result of generating the line disconnection-verifying signal VRY. Also, the CPU of the control section 660 monitors the disconnection of the common line LN2 based on the third detecting signal COM_S provided from the second detecting section 650, and generates the line disconnection control signal R when the common line LN2 is disconnected.

The state displaying section 680 has fifteenth and sixteenth resistors R15 and R16 connected in parallel between the operation voltage terminal +5V and the terminal that generates the line disconnection control signal R and the fire control signal Y of the control section 660, a seventeenth resistor R17 and a fifth light emitting diode LED5 connected in series between the operation voltage terminal +5V and the P1.7(19) terminal of the CPU in the control section 660, and a fourth capacitor C4. The fifth light emitting diode LED5 is a red light emitting diode and it indicates line disconnection or occurrence of fire.

The reset section 670 has an eighteenth resistor R18 and a third electrolytic capacitor EC3 connected in series between the operation voltage terminal +5V and ground. The reset terminal RST of the CPU of the control section 660 is connected between the third electrolytic capacitor EC3 and the eighteenth resistor R18. Accordingly, the control section 660 is automatically reset when the power source turns on.

Figure 8:
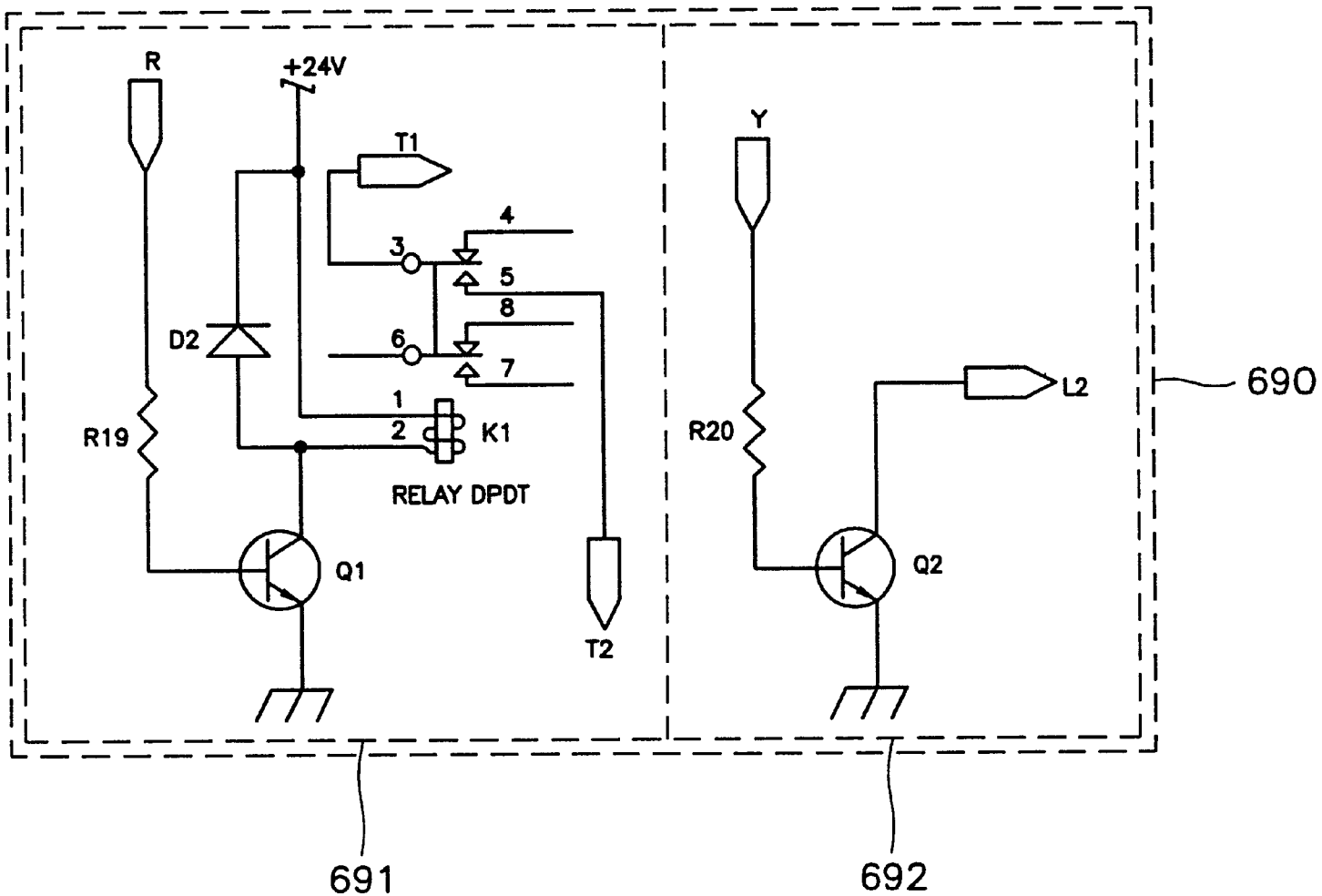
FIG. 8 is a circuit diagram showing a circuit configuration of an alarm driving section of the line disconnection detecting circuit shown in FIG. 2.

Referring to FIG. 8, an alarm driving section 690 has a line disconnection alarm section 691 including a second diode D2, a nineteenth resistor R19, a first transistor Q1, and a relay DPDT to generate the line disconnection driving signals T1 and T2. Also, the alarm driving section 690 has an on-and-off lamp section 692 including a twentieth resistor R20 and a second transistor Q2 to generate the fire driving signal L2. The nineteenth and the twentieth resistors R19 and R20 are respectively operated as bias resistors of the first and the second transistors Q1 and Q2. The first and the second transistors Q1 and Q2 execute switching operations in response to the line disconnection control signal R and the fire control signal Y respectively inputted into base terminals thereof through the nineteenth and the twentieth resistors R19 and R20.

Hereinafter, a description will be given below in detail with the reference to FIGS. 3–9, of an operation of a fire alarm apparatus having the line disconnection detecting circuit as described above.

Figure 9A:
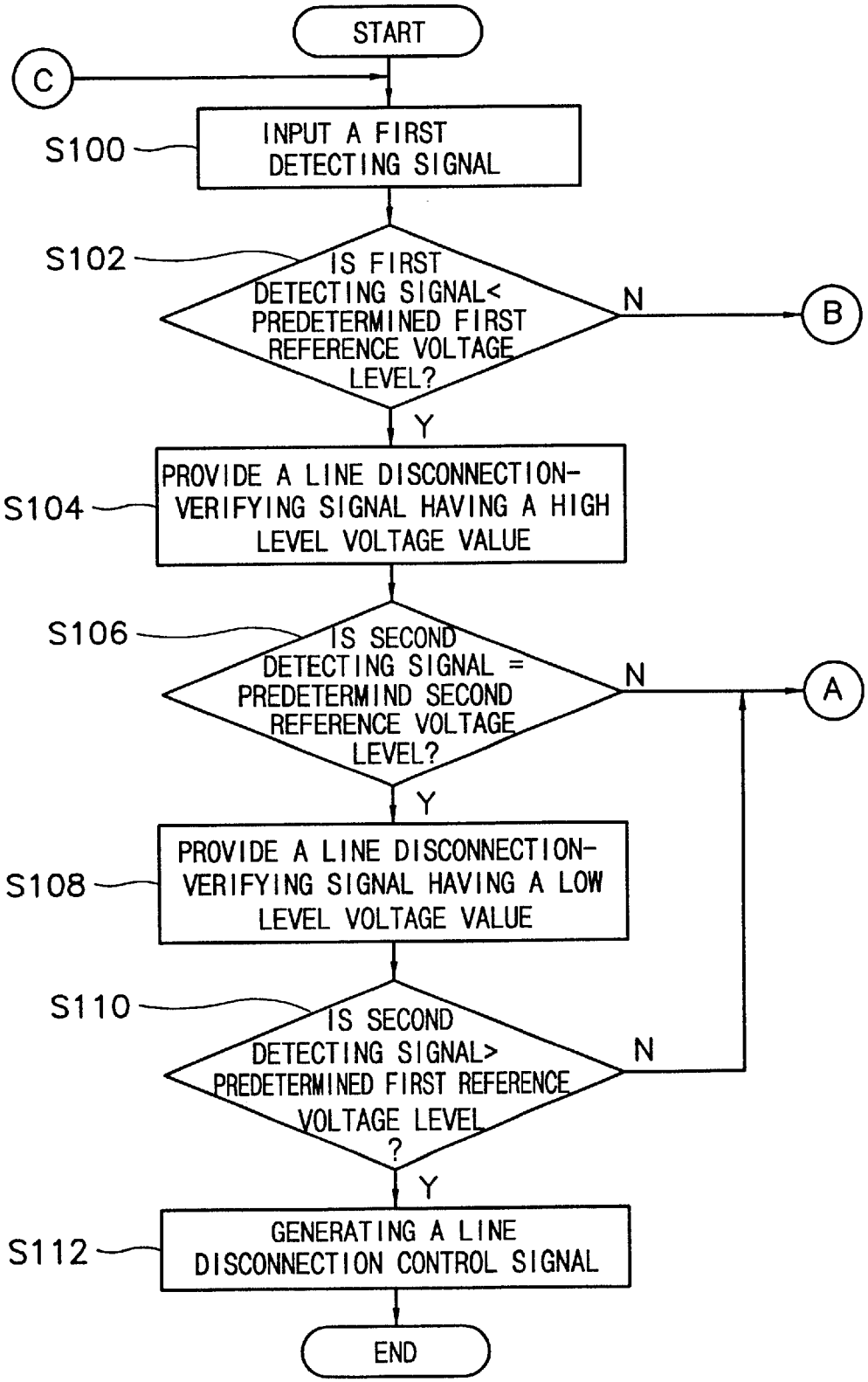
FIGS. 9A to 9C are a flowchart illustrating a method for monitoring line disconnection or a fire in connection with the fire alarm system having the line disconnection detecting circuit shown in FIG. 2.
Figure 9B:
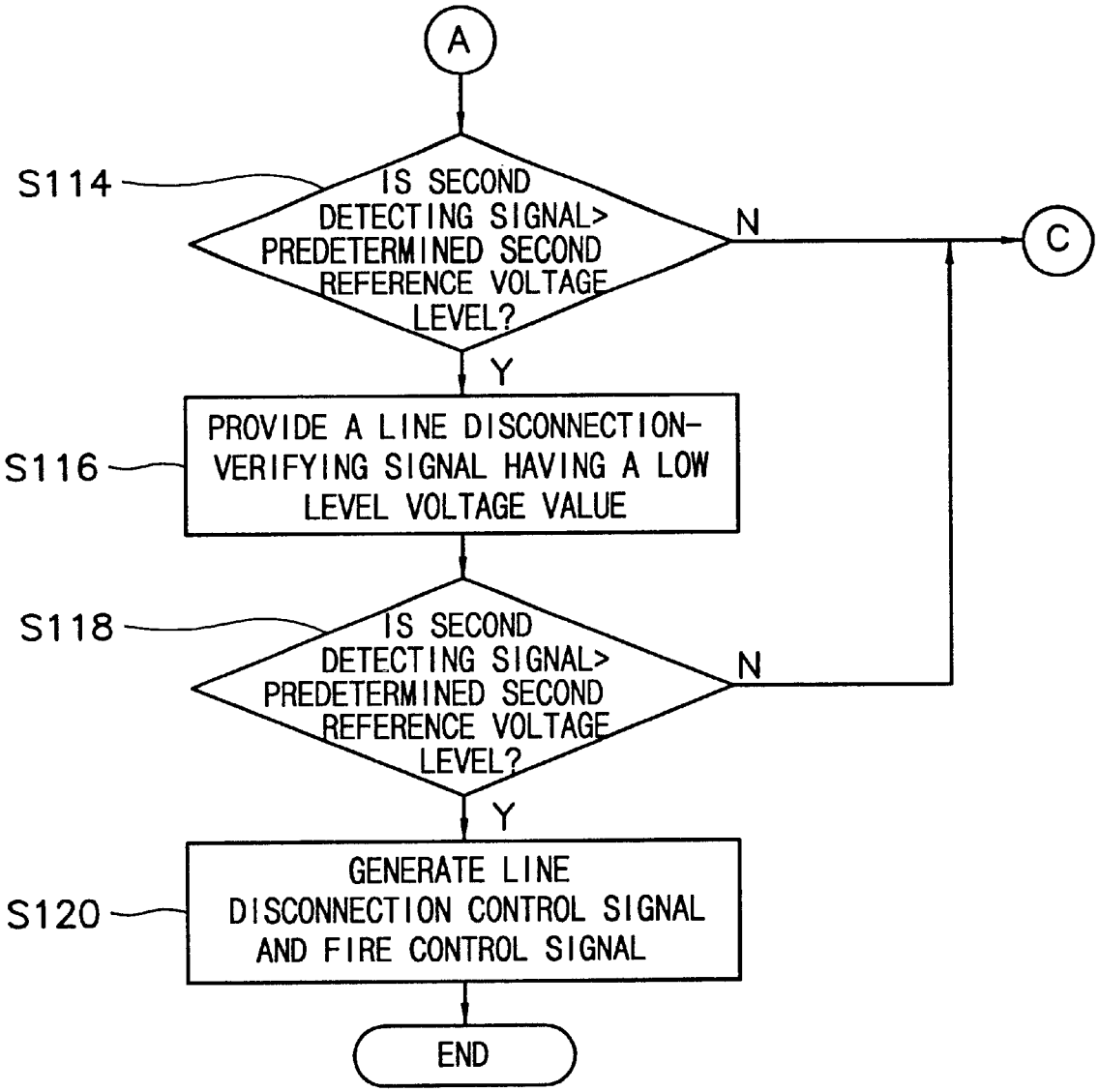
Figure 9C:
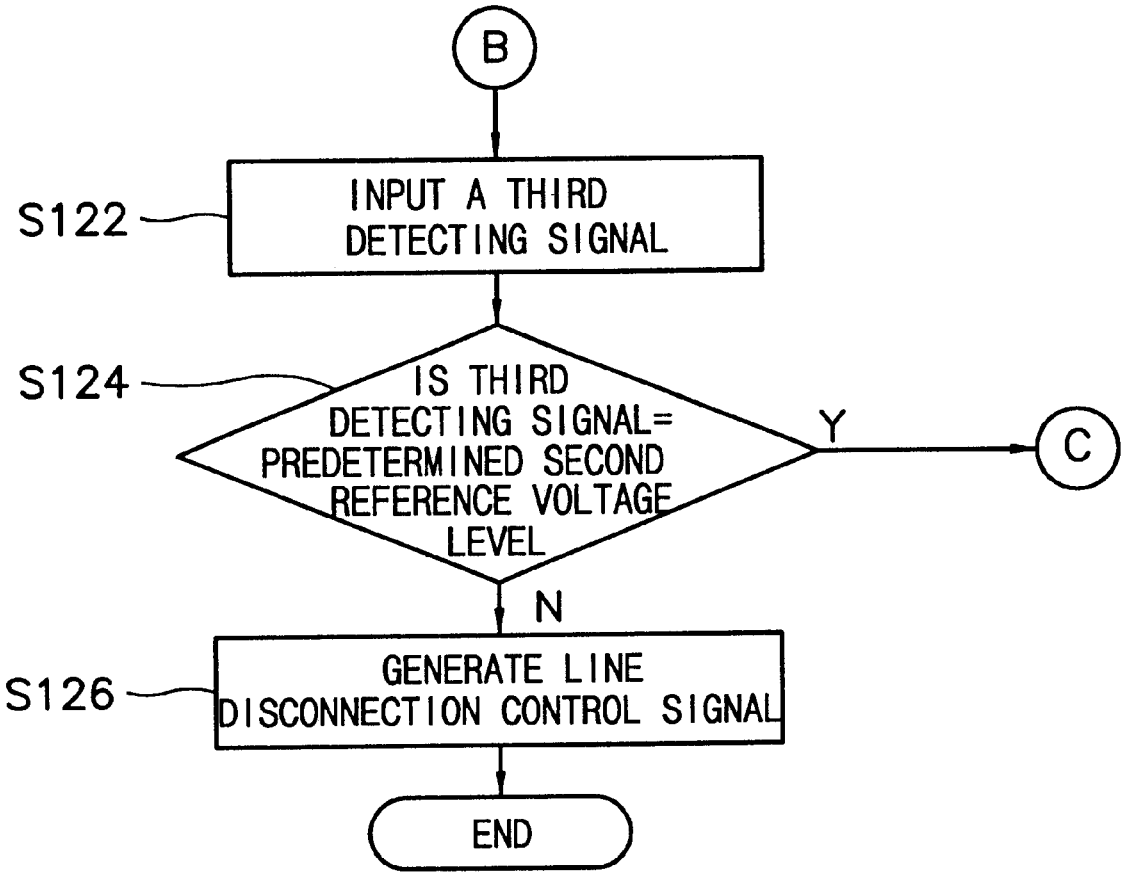

FIGS. 9A to 9C are a flowchart illustrating a method of monitoring line disconnection or occurrence of fire with a detecting apparatus having a line disconnection detecting circuit as shown in FIG. 2. Firstly, when the first detecting section 640 receives the first detecting voltage signal DET representing the voltage state of the plurality of fire detectors 400, 401 and 402 through the operation verifying section 630, the first differential amplifier DA1 outputs a voltage signal of a high level. Accordingly, the third light emitting diode LED3 and the second photo coupler PC2 maintain a turned-off state and the first detecting signal having a voltage value of high level is provided to the control section 660.

The control section 660 receives the first detecting signal from the first detecting section 640 (step S100). The control section 660 checks whether or not the voltage level of the first detecting signal is lower than the predetermined first reference voltage level which is set to be 5 volts (Step S102).

In step S102, when the voltage level of the first detecting signal is not lower than the predetermined first reference voltage level, the control section 660 judges that the operation state of the plurality of the fire detectors 400, 401 and 402 and the detecting line LN1 is normal and then proceeds to step S122 in FIG. 9C.

In step S102, when the voltage level of the first detecting signal is lower than the predetermined first reference voltage level (5 volts for example), processing flows to steps S104. In step S104, control section 660 provides the line disconnection-verifying signal VRY to the operation verifying section 630 to determine whether or not the detecting line LN1 is disconnected or whether or not a fire has occurred. At this time, the line disconnection-verifying signal VRY has to be alternatively provided, as a line disconnection-verifying signal of high level and as a line disconnection-verifying signal of low level, regardless of the order. In an exemplary embodiment of the present invention, a description will be given under the assumption that a line disconnection-verifying signal having a voltage value of a high level is provided first.

When the line disconnection-verifying signal VRY having the voltage value of the high level is generated from the control section 660, the second light emitting diode LED2 and the first photo coupler PC1 of the operation verifying section 630 maintain the turned-off state. Accordingly, the voltage signal inputted through the detecting line terminal is provided to the control section 660 as the second detecting signal.

The control section 660 then checks whether or not the voltage level of the second detecting signal is identical with a predetermined second reference voltage level, which is set to be 0 volt (Step S106). The control section 660 proceeds to step S114 when the voltage level of the second detecting signal is not identical with the predetermined second reference voltage level. When the voltage level of the second detecting signal is identical to the predetermined second reference voltage level, the control section 660 provides the line disconnection-verifying signal VRY having a voltage value of a low level to the operation verifying section 630. (Step S108).

If the line disconnection-verifying signal VRY having the voltage value of the low level is generated from the control section 660, the second light emitting diode LED2 and the first photo coupler PC1 of the operation verifying section 630 are electrically turned-on in sequence. Accordingly, a voltage signal having the voltage level of +24V provided to the second photo coupler PC2 is applied to the first differential amplifier DA1. Therefore, the second detecting signal, which is provided from the first detecting section 640 to the control section 660 and which corresponds to the generation of the line disconnection-verifying signal VRY having the voltage value of the low level, has a voltage value of the high level.

The control section 660 then checks whether or not the voltage level of the second detecting signal, which is inputted by means of generating the line disconnection-verifying signal VRY having the voltage value of the low level, is higher than the first reference voltage level (Step S110).

In step S110, the control section 660 proceeds to step S114 when the voltage level of the second detecting signal is not higher than the first reference voltage level. In step S110, the control section 660 generates the line disconnection control signal R when the voltage level of the second detecting signal is higher than the first reference voltage level (Step S112).

When the line disconnection-verifying signal VRY is alternatively provided as having a voltage value of the low level and the high level, the fact that the voltage level of the generated second detecting signal caused by the line disconnection-verifying signal VRY is outputted as a voltage level opposite to the voltage level of the line disconnection verifying signal VRY, indicates disconnection of the detecting line LN1. This means that if the first detecting voltage signal DET is lower than the first reference voltage level, and this occurs not because of disconnection of the detecting line LN1 but because of a fire, the voltage level of the second detecting signal has to be maintained within the range of a uniform voltage level, regardless of the voltage level of the line disconnection-verifying signal VRY. In addition, the fact that the voltage level of the second detecting signal is not identical with the second reference voltage level, or not higher than the first reference voltage level, indicates that the reason for the voltage drop of the first detecting signal below the first reference voltage level is not because of line disconnection of detecting line LN1.

Accordingly, control section 660 checks whether or not the voltage level of the second detecting signal generated by means of providing the line disconnection-verifying signal having the voltage value of the high level, is higher than the second reference voltage level (step S114). When the voltage level of the second detecting signal is not higher than the second reference voltage level, the control section 660 returns to step S100.

When the voltage level of the second detecting signal is determined to be higher than the second reference voltage level in step S114, the control section 660 provides the line disconnection-verifying signal having the voltage value of the low level to the operation verifying section 630 (step S116). The control section 660 checks whether or not the voltage level of the second detecting signal generated by means of providing the line disconnection-verifying signal having the voltage value of the low level is higher than the second reference voltage level (step S118).

In step S118, when the voltage level of the second detecting signal generated by means of providing the line disconnection-verifying signal having the voltage value of the low level is not higher than the second reference voltage level, the control section 660 returns to step S100. In step S118, when the voltage level of the second detecting signal is higher than the second reference voltage level, processing flows to step S120. In step S120, the control section 660 generates the line disconnection control signal R and the fire control signal Y.

Namely, the fact that the voltage level of the first detecting signal is lower than the first reference level, and the voltage level of the second detecting signal generated corresponding to the line disconnection-verifying signal VRY having either the voltage value of the high level or the low level is higher than the second reference voltage level, indicates that the plurality of fire detectors 400, 401 and 402 are operating within the range from 0 volt to less than 5 volts.

Meanwhile, when the second detecting voltage signal COM representing the voltage state of the common line LN2 of the plurality of fire detectors 400, 401 and 402 is inputted to the second detecting section 650, the third detecting signal COM_S having a low voltage level is provided from the second detecting section 650 to the control section 660. The control section 660 receives the third detecting signal COM_S from the second detecting section 650 (step S122). The control section 660 checks whether or not the voltage level of the third detecting signal COM_S from the second detecting section 650 is identical with the second reference voltage level (step S124). In step S124, the control section 660 returns to step S100 when the voltage level of the third detecting signal COM_S is identical to the second reference voltage level. When the voltage level of the third detecting signal COM_S is not identical to the second reference voltage level, the control section 660 generates the line disconnection control signal R (step S126).

Hereinafter, the line disconnection control signal R generated from the control section 660 is provided to the line disconnection alarm section 691. When the first transistor Q1 of the line disconnection alarm section 691 is turned on in response to the line disconnection control signal R, the line disconnection driving signals T1 and T2 are provided to the repeater 200 by means of operating the relay DPDT. Therefore, the operators at the control center (not shown) can recognize disconnection of the detecting line LN1 or the common line LN2 of the plurality of fire detectors 400, 401 and 402, by the line disconnection alarm signal from the line disconnection alarm generator Meanwhile, the fire control signal Y generated from the control section 660 is provided to the on-and-off lamp section 692. When the second transistor Q2 of the on-and-off lamp section 692 is turned on by the fire control signal Y, the fire driving signal L2 is provided to an on-and-off indicating lamp 700.

Accordingly, people in the building are able to recognize the occurrence of the fire by the on-and-off flashing operation of the on-and-off indicating lamp 700. Also, when a fire occurs, the repeater 200 provides a signal which indicates occurrence of fire, to the control center (not shown).

According to the aforementioned fire alarm apparatus, the control section compares the operation voltage level of the plurality of fire detectors during normal times with the predetermined reference voltage level. Based on the compared results, the control section generates the line disconnection-verifying signal to receive the detecting signal representing the state of the detecting line and the common line which electrically connects the plurality of fire detectors to each other.

Also, the control section judges whether the common line or the detecting line are disconnected or whether a fire has occurred by comparing the detecting signal with another predetermined reference voltage level, and then generates either the line disconnection control signal or the fire control signal based on the judgement, to control the fire alarm system. Accordingly, the control section is able to monitor the state of the detecting line, the common line and the fire detector, regardless of the installation place of the terminal endpoint resistor that is connected between the detecting line and the common line for the purpose of checking line disconnection of the plurality of fire detectors.

Furthermore, the on-and-off indicating lamp carries out on-off flashing operation by means of the output section driven in response to the fire control signal. Therefore, an in-house fireplug may be easily located, even if there is a lot of smoke.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An apparatus for monitoring line disconnection and occurrence of fire, comprising:

an operation verifier that outputs a first detecting voltage signal representing an operation state of a fire detector and that outputs a verification-confirming signal in response to a line disconnection-verifying signal;

a first detector that outputs first and second detecting signals respectively representing an operation state of the fire detector and a state of a first line of the fire detector, in response to the first detecting voltage signal and the verification-confirming signal;

a second detector that receives a second detecting voltage signal representing the operation state of the fire detector and outputs a third detecting signal representing a state of a second line of the fire detector; and a controller that receives the first, second and third detecting signals, compares a voltage level of the first detecting signal with a voltage level of a predetermined first reference value, provides the line disconnection-verifying signal to said operation verifier according to a comparison result, based on the second detecting signal generated in accordance with a result of providing the line disconnection-verifying signal generates either a first line disconnection control signal to provide indication of a first line disconnection of the fire detector or a fire control signal to provide indication of occurrence of fire, and based on a comparison of a voltage level of the third detecting signal with a voltage level of a predetermined second reference value generates a second line disconnection control signal to provide indication of a second line disconnection of the fire detector.

2. The apparatus of claim 1, wherein the voltage level of the predetermined first reference value and the voltage level of the predetermined second reference value are 5 volts and 0 volt, respectively.

3. The apparatus of claim 1, wherein the line disconnection-verifying signal is alternatively provided by said controller as a voltage signal having a voltage value of low level and as a voltage signal having a voltage value of high level, and as having a predetermined period.

4. The apparatus of claim 3, wherein said controller generates the first line disconnection control signal when a voltage level of the second detecting signal is output as a voltage level opposite to a voltage level of the line disconnection-verifying signal applied to said operation verifier.

5. The apparatus of claim 1, further comprising:

a first alarm that provides indication of line disconnection of the fire detector in response to either the first or the second line disconnection control signals; and a second alarm that provides indication of occurrence of fire in response to the fire control signal.

6. An apparatus for monitoring line disconnection and occurrence of fire, comprising:

a plurality of detectors that detect occurrence of fire to output a fire occurring signal;

a controller that receives through a line of said plurality of detectors a detecting voltage signal representing a present voltage state of said plurality of detectors, compares a voltage level of the detecting voltage signal with a predetermined reference voltage level, and based on a comparison result generates either a line disconnection control signal or a fire control signal respectively representing disconnection of the line of said plurality of detectors and the occurrence of fire;

a first alarm that provides indication of the disconnection of the line of said plurality of detectors in response to the line disconnection control signal; and a second alarm that provides indication of the occurrence of fire in response to the fire control signal, wherein said controller comprises:

an operation verifier that receives and outputs the detecting voltage signal representing an operation state of said plurality of detectors and outputs a verification-confirming signal in response to a line disconnection-verifying signal;

a detector, responsive to the detecting voltage signal and the verification-confirming signal, that outputs first and second detecting signals respectively representing the operation state of said plurality of detectors and a line disconnection state of said plurality of detectors; and a detecting controller that receives the first and the second detecting signals, compares a voltage level of the first detecting signal with a voltage level of a predetermined first reference value, provides the line disconnection-verifying signal to said operation verifier based on a comparison result, and based on the second detecting signal generated in accordance with a result of providing the line disconnection-verifying signal generates either the line disconnection control signal to provide indication of disconnection of the line of said plurality of detectors or the fire control signal to provide indication of occurrence of fire.

7. The apparatus of claim 6, wherein said second alarm emits light by flashing on-and-off.

8. The apparatus of claim 6, wherein the line disconnection-verifying signal is alternatively provided from said detecting controller as a voltage signal having a voltage value of low level or as a voltage signal having a voltage value of high level, and as having a predetermined period.

9. The apparatus of claim 8, wherein said detecting controller generates the line disconnection control signal when a voltage level of the second detecting signal is output as a voltage level opposite to a voltage level of the line disconnection-verifying signal applied to said operation verifier.

10. The apparatus of claim 8, wherein said detecting controller generates the fire control signal when a voltage level of the second detecting signal is maintained within a range of between 0 to 5 volts.

11. The apparatus of claim 6, further comprising an oscillator that provides a clock synchronizing signal to said detecting controller to synchronize operation of said detecting controller.

12. The apparatus of claim 6, further comprising a power supply that provides an external power source voltage as an operation voltage of said operation verifier, said detector, and said detecting controller, after dropping a voltage level of the external power source voltage to a predetermined voltage level.

13. The apparatus of claim 12, further comprising a reset that resets said detecting controller when the operation voltage is provided by said power supply.

14. A method for monitoring line disconnection and occurrence of fire in a fire alarm system, comprising:

comparing whether or not a voltage level of a first detecting signal representing a present voltage state of a fire detector is lower than a voltage level of a predetermined first reference value;

generating a first line disconnection-verifying signal having a voltage value of high level and a second line disconnection-verifying signal having a voltage value of low level when the voltage level of the first detecting signal is lower than the voltage level of the predetermined first reference value, and generating a line disconnection control signal representing line disconnection of the fire detector when a voltage level of a second detecting signal fed back through a line of the fire detector is respectively detected as a voltage level opposite to voltage levels of the first and the second line disconnection-verifying signals; and generating a fire control signal representing occurrence of fire regardless of the voltage levels of the first and second line disconnection-verifying signals, when the voltage level of the second detecting signal fed back through the line of the fire detector is detected as a uniform voltage level.

15. The method of claim 14, wherein said comparing comprises:

receiving the first detecting signal representing the present voltage state of the fire detector;

comparing whether or not the voltage level of the first detecting signal is lower than the voltage level of the predetermined first reference value;

repeating said comparing when the voltage level of the first detecting signal is not lower than the voltage level of the first reference value; and proceeding to said generating a first line disconnection-verifying signal and a second line disconnection-verifying signal when the voltage level of the first detecting signal is lower than the voltage level of the predetermined first reference value.

16. The method of claim 14, wherein said generating a first line disconnection-verifying signal and a second line disconnection-verifying signal comprises:

generating the first line disconnection-verifying signal;

checking whether or not the voltage level of the second detecting signal that is fed back through the line of the fire detector responsive to the first line disconnection-verifying signal, is identical with a voltage level of a predetermined second reference value which is set to be different from the voltage level of the first line disconnection-verifying signal;

proceeding to said generating a fire control signal when the voltage level of the second detecting signal is not identical with the voltage level of the predetermined second reference value, and generating the second line disconnection-verifying signal when the voltage level of the second detecting signal is identical with the voltage level of the predetermined second reference value;

checking whether or not the voltage level of the second detecting signal fed back through the line of the fire detector responsive to the second line disconnection-verifying signal is higher than the voltage level of the predetermined first reference value; and proceeding to said generating a fire control signal when the voltage level of the second detecting signal is not higher than the voltage level of the predetermined first reference value, and generating the line disconnection control signal when the voltage level of the second detecting signal is higher than the voltage level of the predetermined first reference value.

17. The method of claim 16, wherein the voltage level of the predetermined first reference value is 5 volts and the voltage level of the predetermined second reference value is 0 volt.

18. The method of claim 17, wherein said generating a fire control signal comprises:

checking whether or not the voltage level of the second detecting signal fed back through the line of the fire detector responsive to the first line disconnection-verifying signal is higher than the voltage level of the predetermined second reference value;

returning to said comparing when the voltage level of the second detecting signal is not higher than the voltage level of the predetermined second reference level and generating the second line disconnection-verifying signal when the voltage level of the second detecting signal is higher than the voltage level of the predetermined second reference value;

checking whether or not the voltage level of the second detecting signal fed back through the line of the fire detector responsive to the second line disconnection-verifying signal is higher than the voltage level of the predetermined second reference value; and returning to said comparing when the voltage level of the second detecting signal is not higher than the voltage level of the predetermined second reference value and generating the fire control signal when the voltage level of the second detecting signal is higher than the voltage level of the predetermined second reference value.

19. The method of claim 18, further comprising:

receiving a third detecting signal by a detecting voltage signal representing an operation state of the fire detector;

checking whether or not a voltage level of the third detecting signal is identical with the voltage level of the predetermined second reference value, which is set to be identical to a voltage level of the detecting voltage signal;

returning to said comparing when the voltage level of the third detecting signal is identical with the voltage level of the predetermined second reference value; and generating the line disconnection control signal when the voltage level of the third detecting signal is not identical with the voltage level of the predetermined second reference value.

20. The method of in claim 19, wherein the voltage level of the detecting voltage signal and the voltage level of the predetermined second reference value are 0 volt, respectively.

* * * * *